US005414984A

United States Patent [19]

Groshens et al.

[11] Patent Number: 5,414,984

[45] Date of Patent: May 16, 1995

[54] REINFORCEMENT THREAD FOR FABRIC COVERING OR TECHNICAL TEXTILES

[75] Inventors: Pierre Groshens, Peronne; Fabrice Covet, Roisel, both of France

[73] Assignee: Lainiere De Picardie, Peronne, France

[21] Appl. No.: 888,309

[22] Filed: May 27, 1992

Related U.S. Application Data

[63] Continuation of Ser. No. 607,805, Nov. 1, 1990, abandoned.

[30] Foreign Application Priority Data

Nov. 15, 1989 [FR] France ..... 89 14975

[51] Int. Cl.[6] ..... D02G 3/38; D02G 3/40

[52] U.S. Cl. ..... 57/234; 57/224; 57/227; 57/230; 57/232

[58] Field of Search ..... 57/210, 234, 224, 225, 57/226, 227, 228, 230, 232

[56] References Cited

U.S. PATENT DOCUMENTS

| | | | |
|---|---|---|---|
| 1,766,776 | 6/1930 | Chisholm | 57/234 X |
| 2,076,273 | 4/1937 | Harris | 57/224 X |
| 2,475,083 | 7/1949 | Davis | 57/234 |
| 3,380,244 | 4/1968 | Martin | 57/226 |
| 3,382,662 | 5/1968 | Seelig et al. | 57/234 X |
| 3,857,229 | 12/1974 | Marzocchi | 57/234 X |
| 4,454,709 | 6/1984 | Wahl | 57/223 |
| 4,557,967 | 12/1985 | Willensen et al. | 57/251 X |
| 4,958,485 | 9/1990 | Montgomery et al. | 57/210 |

FOREIGN PATENT DOCUMENTS

| | | | |
|---|---|---|---|
| 0339965 | 11/1989 | European Pat. Off. | 57/234 |
| 2270355 | 3/1974 | France . | |
| 3000273 | 7/1980 | Germany | 57/234 |

*Primary Examiner*—Daniel P. Stodola
*Assistant Examiner*—William Stryjewski
*Attorney, Agent, or Firm*—Popham, Haik, Schnobrich & Kaufman, Ltd.

[57] ABSTRACT

A reinforcement thread (1) for fabric coverings or technical textiles, intended to be incorporated in a textile base which comprises a synthetic or artificial core thread (2) and first cladding fibers (3) deposited about the core thread (2). The first cladding fibers (3) are bonded to the core thread (2).

28 Claims, 2 Drawing Sheets

REINFORCEMENT THREAD FOR FABRIC COVERING OR TECHNICAL TEXTILES

This application is a continuation of U.S. patent application Ser. No. 07/607,805, filed Nov. 1, 1990, now abandoned.

The invention relates to reinforcement threads for fabric coverings or technical textiles as well as the method of producing same.

Such threads are intended to be woven or to be inserted in a knitted fabric. They are frequently used in articles employed for fabric coverings of the tailoring cloth or shirt front type. They add wiriness and strength to the products in which they are incorporated.

BACKGROUND OF THE INVENTION

In fabric coverings, threads of animal hair have been used for a long time for such reinforcement threads. Attempts have already been made to replace such natural threads by synthetic monofilament threads which have wiriness and strength close to those of natural hair. However, the use of such synthetic fibres remains limited for the threads thus obtained tend to slip inside the structure of the fabrics.

To prevent such slipping, it has already been proposed to coat the fabric after the weaving or knitting operation with a bending agent, for example with acrylic resins. This method avoids the above slipping but makes the textile rigid since, following coating with the bonding agent, the threads are all connected together at their contact point. This method does not then make it possible to obtain textiles which, while having the desired wiriness and strength, maintain good flexibility and good resilience.

It has also been envisaged to twist two threads of the same length together, for example a monofilament thread and a hairy thread. The rough surface of the hairy thread ensures the non-slip of the composite thread (FR-A-2 270 355). Such a method cannot be used with threads having great rigidity which would remain rectilinear during a twisting attempt.

SUMMARY OF THE INVENTION

The aim of the present invention is to provide a composite reinforcement thread, partially synthetic, whose structure avoids slipping in the texture of the woven or knitted fabric in which they are incorporated, avoiding the need to coat the textile or knitted fabric in which it is incorporated with a bonding agent.

To solve this problem, the invention provides a reinforcement thread for fabric coverings or technical textiles intended to be incorporated in a textile base, characterized in that it comprises a thread with synthetic or artificial core, first cladding fibres deposited about the core thread, the first cladding fibres being bonded to the core thread by means of an adhesive substance, these first cladding fibres forming roughnesses which give relief to the reinforcement thread.

The first cladding fibres may form a thread which is wound about the core thread. They may also be individualized and associated with the core thread by the friction spinning process.

In a preferred embodiment, this reinforcement thread comprises second cladding fibres lodged in the roughnesses formed by the cladding thread and intended to modify the feel of the reinforcement thread.

The invention also relates to the method of manufacturing a reinforcement thread for fabric coverings or technical textiles in which the first cladding fibres are wound about a core thread, the core thread—cladding thread assembly being impregnated with an adhesive substance then squeezed and dried.

In a preferred embodiment of this manufacturing method, second cladding fibres are lodged in the roughnesses formed by the first cladding fibres, for example by friction spinning.

BRIEF DESCRIPTION OF THE DRAWINGS

The invention will be described in detail with reference to the accompanying drawings in which.

DESCRIPTION OF THE PREFERRED EMBODIMENTS

The reinforcement thread 1 for fabric coverings or technical textiles is intended to be incorporated in a textile base. When this textile base is a woven fabric, the reinforcement thread 1 is woven; when the base is a knitted fabric, the reinforcement threads are incorporated in the mesh system without participating in the formation thereof. Depending on the intended purpose for the textile, they may be introduced parallel to the mesh columns or on the contrary perpendicular thereto.

These reinforcement threads have a diameter generally greater than 10 hundredths of a millimeter.

The reinforcement thread comprises a synthetic or artificial core thread 2 and first cladding fibres 3 deposited about the synthetic core thread 2. The first cladding fibres 3 are bonded to the core thread 2 by means of an adhesive substance 4. The core thread 2 is generally monofilament. However, it may also be multifilament.

The core thread 2 is made from a synthetic or artificial material such as polyamide, polyester or viscose.

The adhesive substance 4 for bending the first cladding fibres 3 to the core thread 2 comprise a heat hardenable polymer. It may also, in addition, or alternately, comprise a crosslinkable polymer. The bending may also be obtained using a heat meltable polymer or heat meltable fibres associated in a mixture with the first cladding fibres 3 or incorporated parallel to the core thread 2 at the time of coating.

Figure 1:
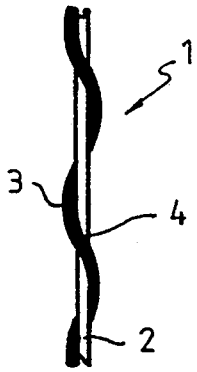
FIG. 1 shows the reinforcement thread of the invention in a first embodiment.
Figure 3:
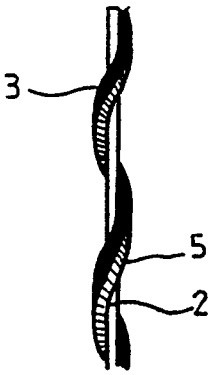
FIG. 3 shows the reinforcement thread of the invention in a third embodiment.
Figure 5A:
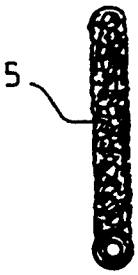
FIGS. 5*a* and 5*b* show the reinforcement thread of the invention in a fifth embodiment, respectively seen from the front and in section.
Figure 5B:
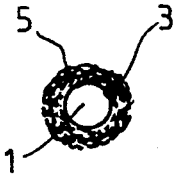

The first cladding fibres 3 may form a thread which is wound about the core thread 2 (FIGS. 1, 3 and 5). The cladding thread 3 gives a relief to the thread 2, 3. These two threads 2, 3 associated by bending are fast with one another. The relief of the thread thus formed allows it to catch on to the texture of the fabric in which it is incorporated and so prevent slipping. The cladding thread 3 may be made from short fibres or from filaments.

Figure 2A:
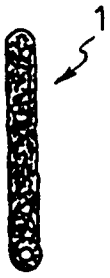
FIGS. 2*a* and 2*b* show the reinforcement thread of the invention in a second embodiment, respectively seen from the front and in section.
Figure 2B:
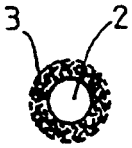
Figure 4A:
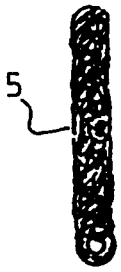
FIGS. 4*a* and 4*b* show the reinforcement thread of the invention in a fourth embodiment, respectively seen from the front and in section.
Figure 4B:
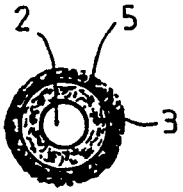

The first cladding fibres 3 may also be individualized and associated with the core thread in the friction spinning method. These fibres 3 are then bonded to the core thread 2 (FIGS. 2 and 4). Thus, the first cladding fibres also give relief to the thread which allows it to catch on to the texture of the fabric with which it is incorporated and prevent it from slipping.

The term "individualized" is used here to qualify the state of the fibres used in the friction spinning process as opposed to fibres which have been subjected to twisting and form a thread or else as opposed to filaments of great length.

It is particularly interesting to improve the feel of the thread comprising the first cladding fibres 2, 3 by associating second cladding fibres 5 lodged in the roughnesses formed by the first cladding fibres 3.

The second cladding fibres may form a cladding thread which is wound in a spiral about the core thread—first cladding thread 2, 3 assembly (FIG. 3). In the case where the first cladding fibres 3 themselves form a thread wound spirally about core 2, the second cladding thread 5 preferably forms a spiral of the same pitch. It may be multifilament.

It is also possible to use individualized second cladding fibres 5 which are inserted between the roughnesses formed by the first cladding fibres 3.

In a first embodiment described hereafter, the first cladding fibres 3 form a thread (FIGS. 1, 3 and 5).

Figure 6A:
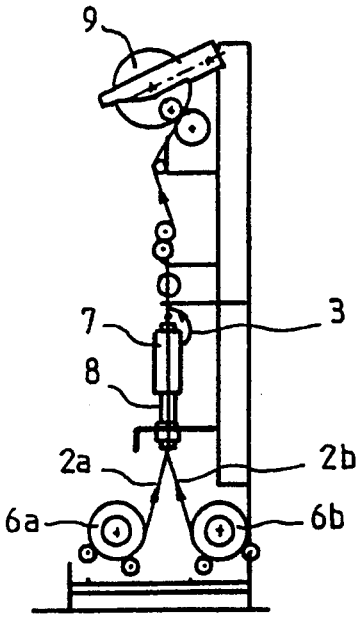
FIG. 6*a* shows the lapping of the core thread with the cladding thread.

During manufacture of the reinforcement thread 1 for fabric coverings or technical textiles, a cladding thread 3 is first of all wound in a spiral about a core thread 2. The apparatus for implementing this manufacturing phase is shown in FIG. 6*a*. The core thread 2 is fed from a reel 6 and the cladding thread 3 from the hollow reel 7. When the core thread 2 is multifilament (2*a*, 2*b*) it is formed from several reels such as 6*a* and 6*b*.

The lapping pin 8 wraps the cladding thread 3 in a spiral about the core thread 2. The thread 2, 3 thus obtained is wound on reel 9.

Figure 6B:
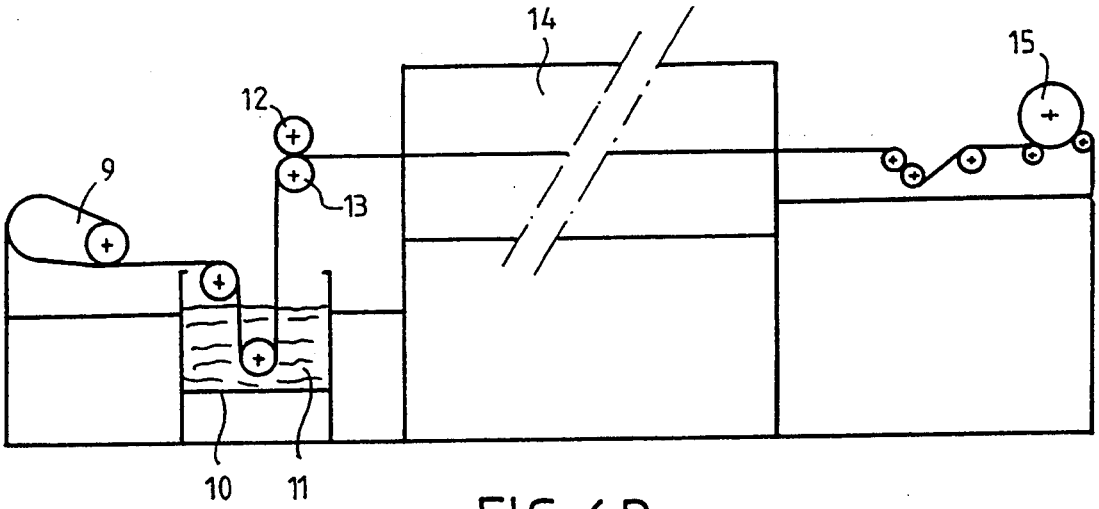
FIG. 6*b* shows coating of the lapped thread with a bonding agent.

After this winding and lapping phase, the core thread 2—cladding thread 3 assembly is impregnated with an adhesive substance 4 then squeezed and dried which permits relative interlocking of these two threads (FIG. 6*b*). For this, the thread 2, 3 fed from reel 9 passes through an impregnation tank 10 filled with an adhesive substance 11 comprising a heat hardenable polymer and/or a crosslinkable polymer. The thread 2, 3 is then squeezed between rollers 12, 13 and dried as it passes through the oven 14 then wound on reel 15.

The term "drying" used here covers all the physical or chemical phenomena likely to occur after bonding to produce adhesion of the cladding thread 3 on the core thread 2. In particular, the adhesive polymer may be crosslinked when passing through this oven.

Other methods of firmly fixing together the core thread with the cladding threads may be used, such as:

- impregnation of the threads with liquid polymers in the solvent phase,
- impregnation of the threads with heat meltable polymers brought into contact in the molten state either by impregnation in a tank kept at a high temperature or by using a die or by spraying,
- by incorporating heat meltable fibres which will be caused to melt subsequently and will ensure bonding of the threads together or of the cladding fibres with the core thread,
- by impregnation with synthetic resins or polymers sensitive to radiation of UV type, microwaves, etc . . .

The adhesive substance 4 may comprise a heat hardenable, for example acrylic, resin with a melanine, formol, polyester etc. base . . . or polymers crosslinkable by UV radiation.

Figure 6C:
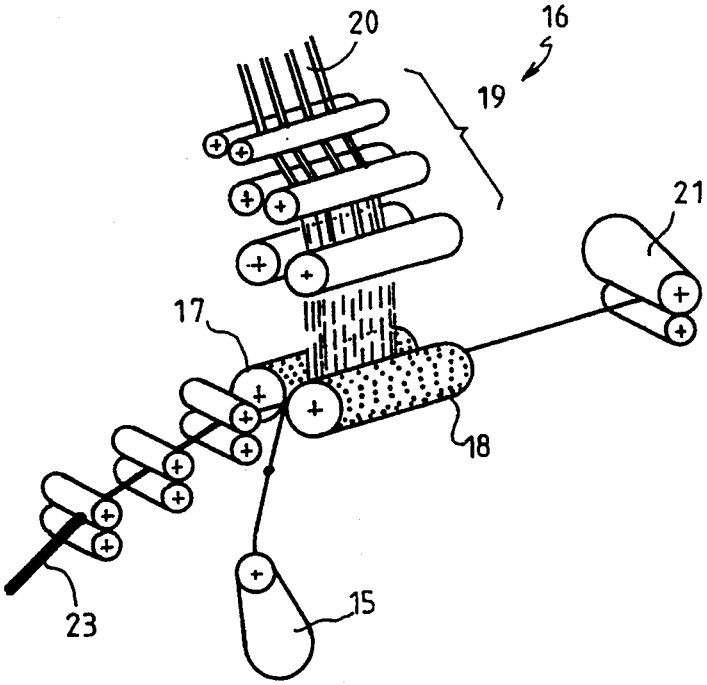
FIG. 6*c* shows the association of the cladding fibres on the thread by friction spinning.

In a second embodiment, the first cladding fibres 3 may be individualized and be associated with the core thread using the friction spinning process. These fibres 3 are then bonded to the core thread 2. The phase of lapping the first cladding fibres described above (FIG. 6*a*) is replaced by a phase of cladding the first fibres 3 by friction spinning (FIG. 6*c*). The other phases of the process are then unchanged.

Figure 6D:
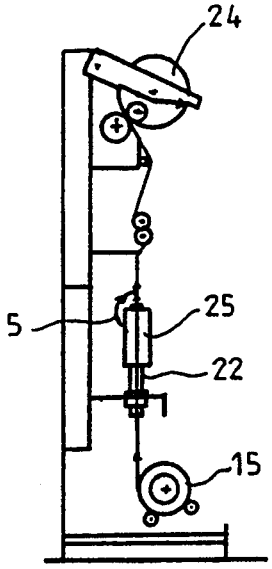
FIG. 6*d* shows the association of the second fibres by lapping on the thread.

Whether the first cladding fibres 3 form a thread or whether they are individualized and are associated with the core thread by friction spinning, it is possible to improve the feel of the thread by depositing second cladding fibres 5 on the first cladding fibres 3. The second cladding fibres 5 are lodged in the roughnesses formed by the first cladding fibres 3. This may be carried out in two ways:

- the second cladding may be carried out with discontinuous fibres using the friction spinning method known per se (FIG. 6*c*). The reel 15 of bonded thread is used to feed a spinning machine 16 comprising perforated spinning drums 17, 18. These drums are also fed via rollers 19 with a fibre roving 20, the fibres 20 are associated with the bonded core thread—cladding fibre 2, assembly. Fibres 20 then form the second cladding fibres 5 lodged in the roughnesses formed by the cladding thread 3 and producing the thread shown in FIG. 3. This thread, ready for use, is then wound on reel 21. It is also possible to introduce fibres 23 parallel to the core, before depositing the cladding fibres 5 so as to obtain a feel of higher quality,
- the second cladding fibres 5 may also form a thread which is itself lapped on the core thread—second cladding fibre 2,3 assembly (FIG. 6*d*). The bonded core thread—first cladding fibre 2,3 assembly is then used for feeding a lapping pin 22 jointly with a hollow reel 25 of the cladding fibre 3. After lapping, the thread obtained is wound on a reel 24.

The core thread 2 is a large sized thread, for example of 300 decitex. The first cladding fibres 3 preferably form a thread of a size between 100 and 150 decitex. The second cladding fibres may be natural, artificial or synthetic in sizes from 0.5 to 9 decitex. The spiral formed by the cladding thread 3 has preferably from 2 to 5 turns to the millimeter.

The synthetic reinforcement threads 1 thus obtained do not slip with respect to the textile structure in which they are incorporated, their feel is mainly determined by the nature of the cladding threads 5 and may then be freely controlled. They may advantageously replace the lapped horsehair threads.

The core threads may have great rigidity, that is, they may be inelastic; the length of the cladding thread is greater than that of the core thread. The cladding thread may be smooth.

What is claimed is:

1. A non-slip reinforcement thread for fabric coverings or technical textiles to be incorporated in a textile base, the reinforcement thread comprising:

a synthetic core thread, wherein the core thread is multifilament;

first cladding fibres deposited about the core thread in helically-wrapped, spaced-apart coils to define a core thread-first cladding fibre assembly, portions of the core thread being exposed between the coils of the first cladding fibres; and an adhesive substance impregnating the core thread-first cladding fibre assembly and bonding the first cladding fibres to the core thread;

wherein the reinforcement thread has a peripheral surface defined by the first cladding fibres, and wherein the spaces between the coils of the first cladding fibres form roughnesses in the peripheral surface of the reinforcement thread, the roughnesses preventing slipping of the reinforcement thread when the reinforcement thread is incorporated in fabric, thereby providing a non-slip peripheral surface.

2. An inelastic non-slip reinforcement thread for fabric coverings or technical textiles to be incorporated in a textile base, the reinforcement thread comprising:

an inelastic synthetic core thread;

first cladding fibres deposited about the core thread in helically-wrapped, spaced-apart coils to define a core thread-first cladding fibre assembly, portions of the core thread being exposed between the coils of the first cladding fibres; and an adhesive substance impregnating the core thread-first cladding fibre assembly and bonding the first cladding fibres to the core thread;

wherein the reinforcement thread has a peripheral surface defined by the first cladding fibres, and wherein the spaces between the coils of the first cladding fibres form roughnesses in the peripheral surface of the reinforcement thread, the roughnesses preventing slipping of the reinforcement thread when the reinforcement thread is incorporated in fabric, thereby providing a non-slip peripheral surface.

3. Reinforcement thread according to claim 2, wherein the first cladding fibres are formed by associating individual fibres with the core thread by friction spinning.

4. Reinforcement thread according to claim 2, further comprising second cladding fibres lodged adjacent the exposed portions of the core thread in the roughnesses formed by the first cladding fibres, wherein the core thread-first cladding fibre assembly has a feel which is modified by the second cladding fibres.

5. Reinforcement thread according to claim 4, wherein the second cladding fibres are staple fibres.

6. Reinforcement thread according to claim 4, wherein the second cladding fibres form a second cladding thread, the second cladding thread being multifilament.

7. Reinforcement thread according to claim 2, wherein the first cladding fibres form a thread which is wound about the core thread.

8. Reinforcement thread according to claim 2, wherein the core thread is monofilament.

9. Reinforcement thread according to claim 2, wherein the core thread is made from polyamide.

10. Reinforcement thread according to claim 2, wherein the core thread is made from polyester.

11. Reinforcement thread according to claim 2, wherein the core thread is made from viscose.

12. Reinforcement thread according to claim 2, wherein the adhesive substance bonding the cladding fibres to the core thread comprises a heat meltable polymer.

13. Reinforcement thread according to claim 2, wherein the adhesive substance bonding the cladding fibres to the core thread comprises a heat hardenable polymer.

14. Reinforcement thread according to claim 2, wherein the adhesive substance bonding the cladding fibres to the core thread comprises a crosslinkable polymer.

15. A non-slip reinforcement thread for fabric coverings or technical textiles to be incorporated in a textile base, the reinforcement thread comprising:

a synthetic core thread;

first cladding fibres deposited about the core thread in helically-wrapped, spaced-apart coils to define a core thread-first cladding fibre assembly, portions of the core thread being exposed between the coils of the first cladding fibres;

an adhesive substance impregnating the core thread-first cladding fibre assembly and bonding the first cladding fibres to the core thread;

wherein the reinforcement thread has a peripheral surface defined by the first cladding fibres, and wherein the spaces between the coils of the first cladding fibres form roughnesses in the peripheral surface of the reinforcement thread, the roughnesses preventing slipping of the reinforcement thread when the reinforcement thread is incorporated in fabric, thereby providing a non-slip peripheral surface; and second cladding fibres lodged adjacent the exposed portions of the core thread in the roughnesses formed by the first cladding fibres, wherein the core thread-first cladding fibre assembly has a feel which is modified by the second cladding fibres.

16. Reinforcement thread according to claim 15, wherein the first cladding fibres form a thread which is wound about the core thread.

17. Reinforcement thread according to claim 15, wherein the core thread is monofilament.

18. Reinforcement thread according to claim 15, wherein the core thread is made from polyamide.

19. Reinforcement thread according to claim 15, wherein the core thread is made from polyester.

20. Reinforcement thread according to claim 15, wherein the core thread is made from viscose.

21. Reinforcement thread according to claim 15, wherein the adhesive substance bonding the cladding fibres to the core thread comprises a heat meltable polymer.

22. Reinforcement thread according to claim 15, wherein the adhesive substance bonding the cladding fibres to the core thread comprises a heat hardenable polymer.

23. Reinforcement thread according to claim 15, wherein the adhesive substance bonding the cladding fibres to the core thread comprises a crosslinkable polymer.

24. Reinforcement thread according to claim 15, wherein the second cladding fibres form a second cladding thread, the second cladding thread being multifilament.

25. Reinforcement thread according to claim 15, wherein the first cladding fibres are formed by associating individual fibres with the core thread by friction spinning.

26. Reinforcement thread according to claim 15, wherein the second cladding fibres are staple fibres.

27. A non-slip reinforcement thread for fabric coverings or technical textiles to be incorporated in a textile base, the reinforcement thread comprising:

a synthetic, monofilament core thread made from polyamide;

first cladding fibres forming a thread helically wound about the core thread in spaced-apart coils to define a core thread-first cladding fibre assembly, wherein portions of the core thread are exposed between the coils of the first cladding fibres, wherein the reinforcement thread has a peripheral surface defined by the first cladding fibres, and wherein the spaces between the coils of the first cladding fibres form roughnesses in the peripheral surface of the reinforcement thread, the roughnesses preventing slipping of the reinforcement thread when the reinforcement thread is incorporated in fabric, thereby providing a non-slip peripheral surface;

an adhesive substance impregnating the core thread-first cladding assembly and bonding the first cladding fibres to the core thread, wherein the adhesive substance comprises a heat meltable polymer; and second cladding fibres lodged adjacent the exposed portions of the core thread in the roughnesses formed by the first cladding fibres, wherein the second cladding fibres modify the feel of the core thread-first cladding fibre assembly, and wherein the second cladding fibres are staple fibres.

28. A non-slip reinforcement thread for fabric coverings or technical textiles to be incorporated in a textile base, the reinforcement thread comprising:

a synthetic, monofilament core thread made from polyester;

first cladding fibres deposited about the core thread in helically-wrapped, spaced-apart coils to define a core thread-first cladding fibre assembly, wherein portions of the core thread are exposed between the coils of the first cladding fibres, wherein the first cladding fibres are formed by associating individualized fibres with the core thread by friction spinning, wherein the reinforcement thread has a peripheral surface defined by the first cladding fibres, and wherein the spaces between the coils of the first cladding fibres form roughnesses in the peripheral surface of the reinforcement thread, the roughnesses preventing slipping of the reinforcement thread when the reinforcement thread is incorporated in fabric, thereby providing a non-slip peripheral surface;

an adhesive substance impregnating the core thread-first cladding assembly and bonding the first cladding fibres to the core thread, wherein the adhesive substance comprises a heat meltable polymer; and second cladding fibres lodged in the roughnesses formed by the first cladding fibres, wherein the core thread-first cladding fibre assembly has a feel which is modified by the second cladding fibres.

* * * * *